US005761825A

United States Patent [19]

Ammon et al.

[11] Patent Number: 5,761,825

[45] Date of Patent: Jun. 9, 1998

[54] HANDS FREE HAIR DRYER AND HOLDER

[76] Inventors: Linda K. Ammon; Edward A. Ammon, both of 2460 Woodsway Dr., Greenwood, Ind. 46143

[21] Appl. No.: 794,181

[22] Filed: Feb. 3, 1997

[51] Int. Cl.[6] ..... A45D 00/00

[52] U.S. Cl. ..... 34/97; 34/90; 34/91

[58] Field of Search ..... 34/90, 91, 96, 34/97; 248/284.1, 288.31, 314, 315, 316.5

[56] References Cited

U.S. PATENT DOCUMENTS 4,712,313 12/1987 Gettleman ..... 34/97

4,972,607 11/1990 Lagace ..... 34/90

5,337,906 8/1994 Digiulio ..... 211/88

5,613,305 3/1997 Narrin ..... 34/90

*Primary Examiner*—Henry A. Bennett

*Assistant Examiner*—Pamela A. O'Connor

*Attorney, Agent, or Firm*—Michael I. Kroll

[57] ABSTRACT

A hands free hair dryer and holder (10) comprising a portable hair dryer (12). A structure (14) is for supporting the portable hair dryer (12) in a stationary adjustable manner, so that a person (16) can position the portable hair dryer (12) towards the hair (18), so that both hands (20) are free to do other things while drying the hair (18).

1 Claim, 5 Drawing Sheets

HANDS FREE HAIR DRYER AND HOLDER

BACKGROUND OF THE INVENTION

1. Field of the Invention

The instant invention relates generally to portable hair dryers and more specifically it relates to a hands free hair dryer and holder. The hands free hair dryer and holder will provide stability for the hair dryer, while allowing both of the hands of the user to be free to do other things.

2. Description of the Prior Art

Numerous portable hair dryers have been provided in prior art that are adapted to be held in the hands of people, for coverting electrical energy to kinetic energy for moving air out from the hair dryers to dry hair on the heads of the people. While these units may be suitable for the particular purpose to which they address, they would not be as suitable for the purposes of the present invention as heretofore described.

SUMMARY OF THE INVENTION

A primary object of the present invention is to provide a hands free hair dryer and holder that will overcome the shortcomings of the prior art devices.

Another object is to provide a hands free hair dryer and holder having an elongated semi-rigid flexible tube extending therefrom to give stability to the portable air dryer, so as to allow both hands of a user of the hair dryer to be free to do other things while drying the hair.

An additional object is to provide a hands free hair dryer and holder in which the elongated semi-rigid flexible tube can be mounted at one end to a wall, positioned upright on a table/counter top or draped over a door, to support the portable hair dryer conveniently in place in a stationary adjustable manner.

A further object is to provide a hands free hair dryer and holder that is simple and easy to use.

A still further object is to provide a hands free hair dryer and holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
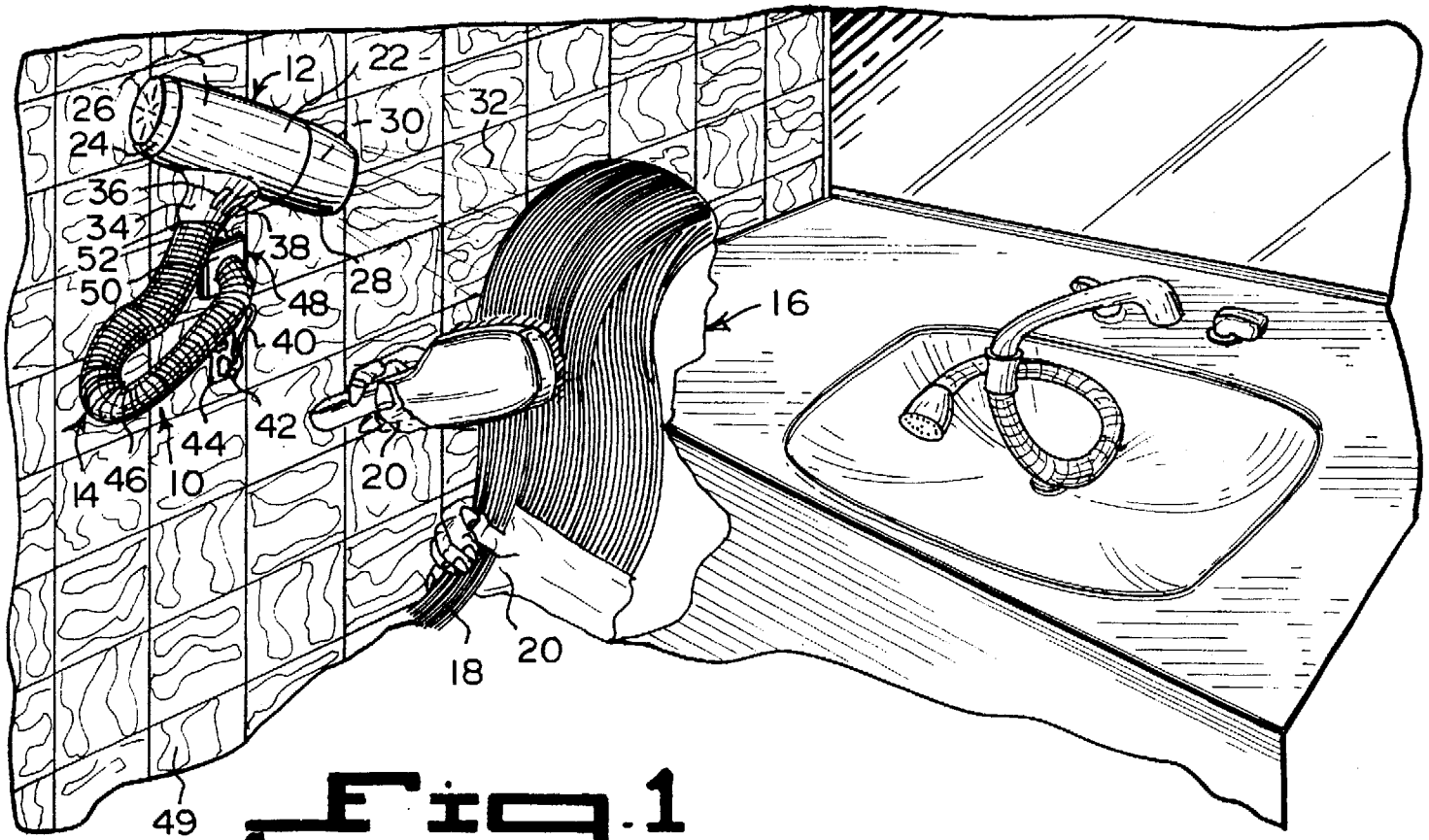
FIG. 1 is a perspective view of a first embodiment of the instant invention mounted to a bathroom tile wall and in use.

Turning now descriptively to the drawings, in which similar reference characters denote similar elements throughout the several views, FIGS. 1 through 4 illustrate a hands free hair dryer and holder 10 comprising a portable hair dryer 12. A structure 14 is for supporting the portable hair dryer 12 in a stationary adjustable manner, so that a person 16 can position the portable hair dryer 12 towards the hair 18, to allow both hands 20 to be free to do other things while drying the hair 18.

The portable hair dryer 12 consists of a housing 22 having air vents 24 and carrying a fan motor 26 therein. A barrel 28 extends from the housing 22 and carries a heater 30 therein, to direct hot air 32 blown from the fan motor 26 within the housing 22 past the heater 30 and out therefrom. A connector handle 34 extends from the housing 22 to engage with the supporting structure 14.

An on/off switch 36 is on the connector handle 34, to turn the fan motor 26 on and off within the housing 22. A heat switch 38 is on the connector handle 34, to operate the heater 30 within the barrel 28. A power cord 40 extends from the connector handle 34 and out through the supporting structure 14. A plug 42 is on a distal end of the power cord 40 to be inserted within a wall socket 44, to receive electrical power to operate the fan motor 26 within the housing 22 and the heater 30 within the barrel 28.

Figure 2:
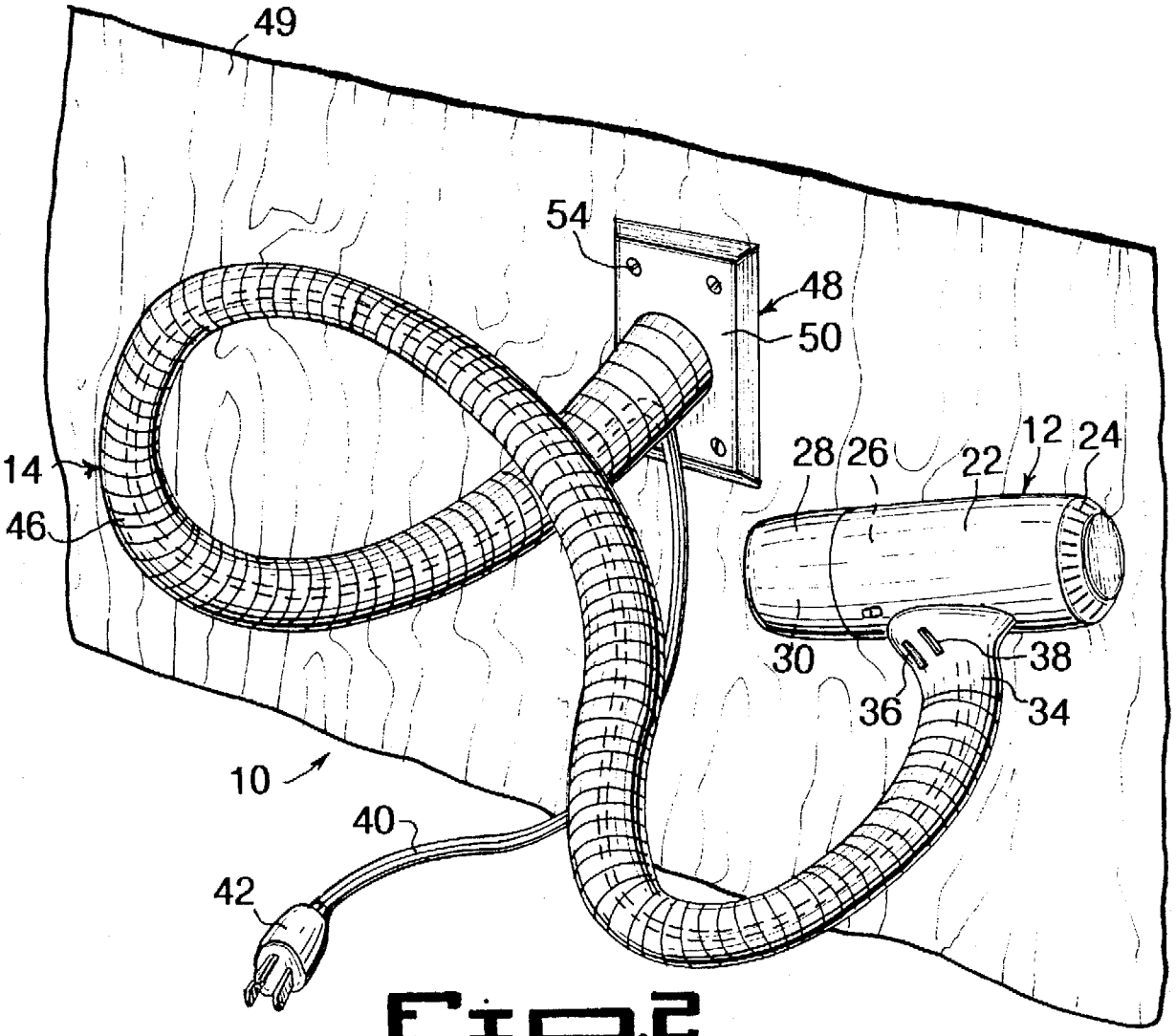
FIG. 2 is a perspective view of the first embodiment mounted to a panel wall.

The supporting structure 14 is an elongated semi-rigid flexible tube 46 which can be bent in any direction and maintained in that position until changed. The hands free hair dryer and holder 10 further includes a facility 48 for attaching one end of the supporting structure 14 to a wall 49, as shown in FIGS. 1 and 2. The attaching facility 48 is a mounting plate 50.

Figure 3:
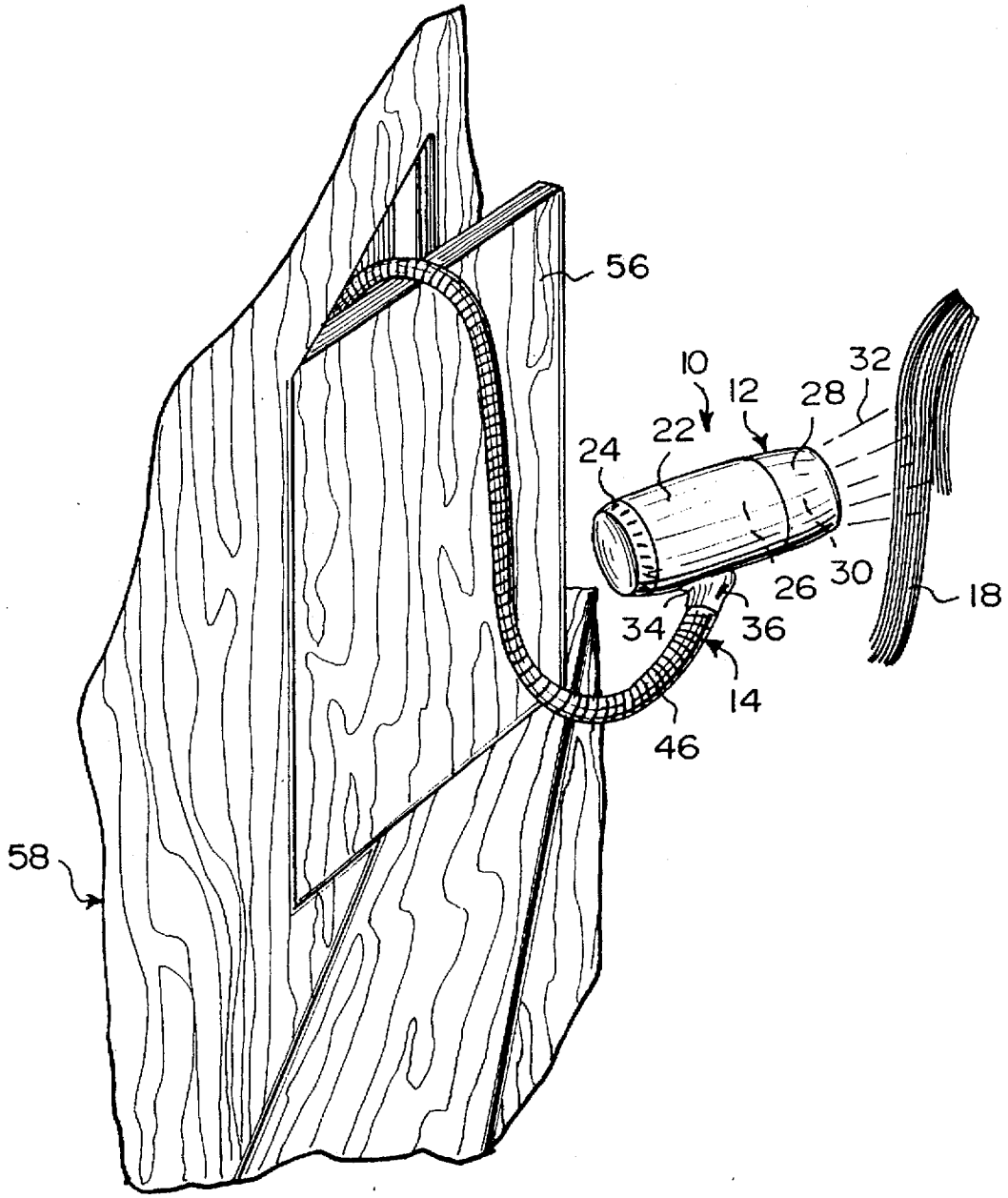
FIG. 3 is a perspective view of a second embodiment of the instant invention hanging over an open door of a cabinet.
Figure 4:
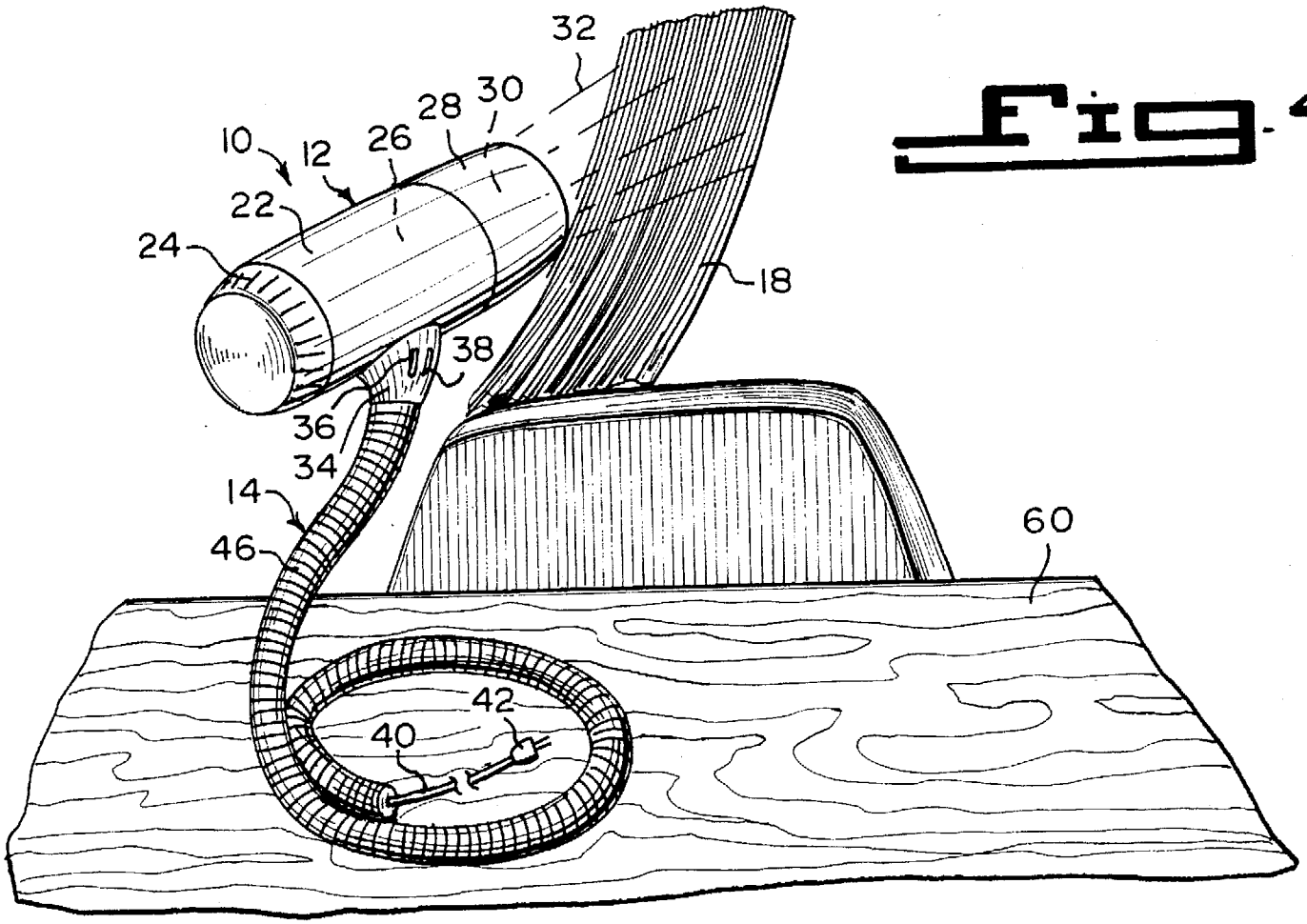
FIG. 4 is a perspective view of the second embodiment positioned upon a table or counter top.

An adhesive layer 52, as shown in FIG. 1, is applied between a rear surface of the mounting plate 50 and the wall 49, which is tile. In FIG. 2, a plurality of screws 54 are provided to retain the mounting plate to the wall 49, which is a wood panel. In FIGS. 3 and 4, the elongated semi-rigid flexible tube 46 is bent over a door 56 in a cabinet 58. In FIG. 4, the elongated semi-rigid flexible tube 46 is coiled upon a table/counter top 60.

Figure 5:
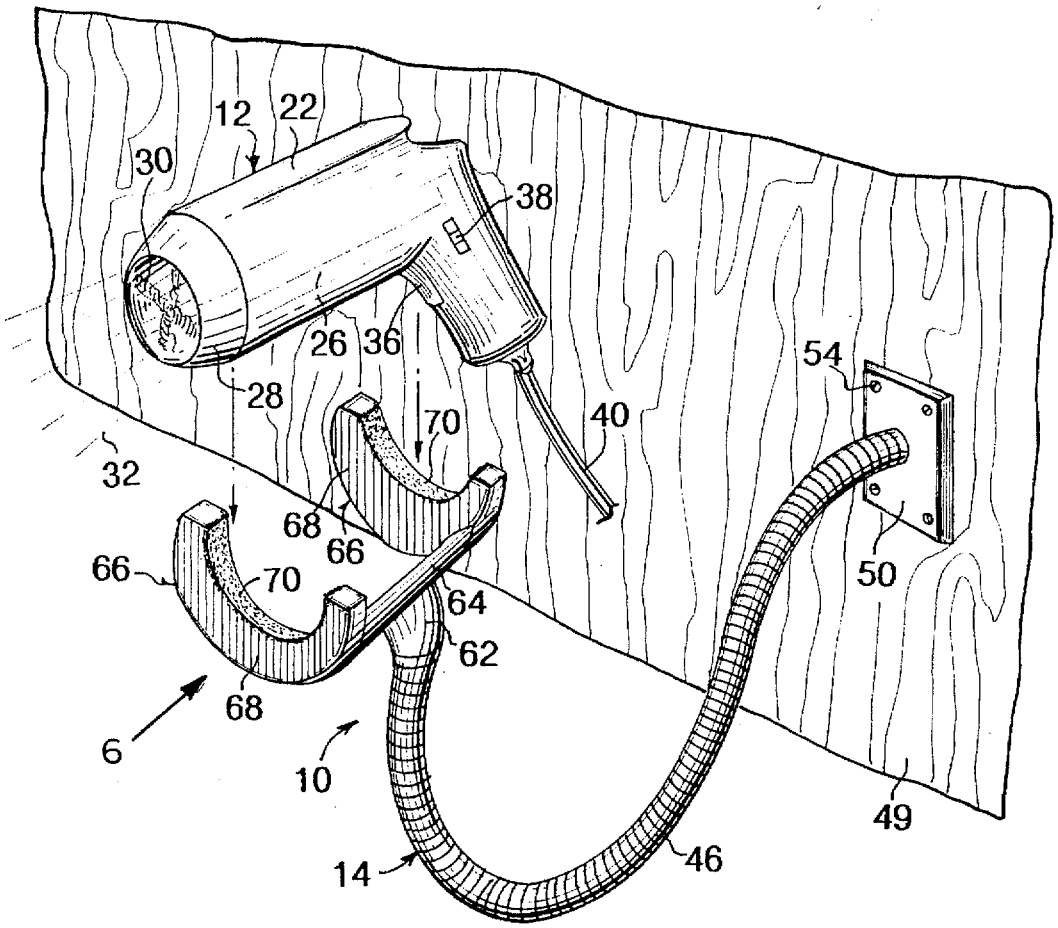
FIG. 5 is a perspective view of a third embodiment of the instant invention mounted to a panel wall, showing a portable hair dryer ready to be placed into the cradle.
Figure 6:
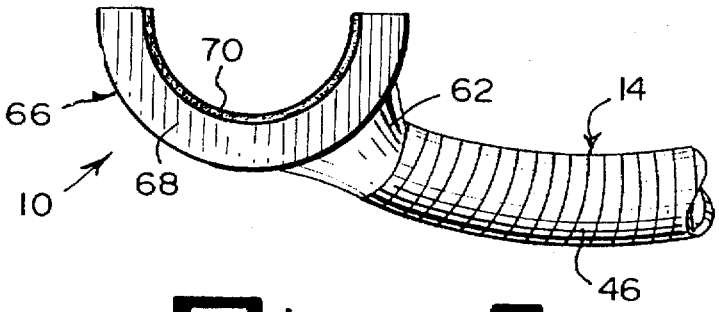
FIG. 6 is an enlarged end view taken in the direction of arrow 6 in FIG. 5, with the elongated semi-rigid flexible tube broken away.

The supporting structure 14 in FIGS. 5 and 6, further contains a connector 62 on a first end of the elongated semi-rigid flexible tube 46. A crossbar 64 is on the connector 62. A pair of cradles 66 are provided. Each cradle 66 is mounted at one side and at a right angle to one end of the crossbar 64, so that the cradles 66 will receive the portable hair dryer 12.

Each cradle 66 includes a C-shaped member 68 turned at ninety degrees. A non-slip pad 70 is secured within the C-shaped member 68, to maintain the portable hair dryer 12 therein. The mounting plate 50 is on a second end of the elongated semi-rigid flexible tube 46. A plurality of the screws 54 are provided, to retain the mounting plate 50 to the wall 49, which is the wood panel.

OPERATION OF THE INVENTION

To use the hands free hair dryer 10 in FIG. 1, the following steps should be taken:

1. Secure the mounting plate 50 to the wall 49 with the adhesive layer 52.
2. Move the elongated semi-rigid flexible tube 46, so that the barrel 28 of the portable hair dryer 12 is aimed at the hair 18 of the person 16.
3. Depress the on/off switch 36 to turn the fan motor 26 on within the housing 22 in the portable hair dryer 12.
4. Adjust the heat switch 38 to operate the heater 30 within the barrel 28 in the portable hair dryer 12, so that the hot air 32 will blow upon the hair 18 of the person, thus leaving the hands 20 of the person 16 free to do other things.

To use the hands free hair dryer 10 in FIG. 2, the following steps should be taken:

1. Secure the mounting plate 50 to the wall 49 with the screws 54.
2. Move the elongated semi-rigid flexible tube 46, so that the barrel 28 of the portable hair dryer 12 is aimed at the hair 18 of the person 16.
3. Depress the on/off switch 36 to turn the fan motor 26 on within the housing 22 in the portable hair dryer 12.
4. Adjust the heat switch 38 to operate the heater 30 within the barrel 28 in the portable hair dryer 12, so that the hot air 32 will blow upon the hair 18 of the person, thus leaving the hands 20 of the person 16 free to do other things.

To use the hands free hair dryer 10 in FIG. 3, the following steps should be taken:

1. Bend the elongated semi-rigid flexible tube 46 over the open door 56 in the cabinet 58.
2. Move the elongated semi-rigid flexible tube 46, so that the barrel 28 of the portable hair dryer 12 is aimed at the hair 18 of the person 16.
3. Depress the on/off switch 36 to turn the fan motor 26 on within the housing 22 in the portable hair dryer 12.
4. Adjust the heat switch 38 to operate the heater 30 within the barrel 28 in the portable hair dryer 12, so that the hot air 32 will blow upon the hair 18 of the person, thus leaving the hands 20 of the person 16 free to do other things.

To use the hands free hair dryer 10 in FIG. 4, the following steps should be taken:

1. Coil the elongated semi-rigid flexible tube 46 upon the table/counter top 60.
2. Move the elongated semi-rigid flexible tube 46, so that the barrel 28 of the portable hair dryer 12 is aimed at the hair 18 of the person 16.
3. Depress the on/off switch 36 to turn the fan motor 26 on within the housing 22 in the portable hair dryer 12.
4. Adjust the heat switch 38 to operate the heater 30 within the barrel 28 in the portable hair dryer 12, so that the hot air 32 will blow upon the hair 18 of the person, thus leaving the hands 20 of the person 16 free to do other things.

To use the hands free hair dryer 10 in FIGS. 5 and 6, the following steps should be taken:

1. Secure the mounting plate 50 to the wall with the screws 54.
2. Place the portable hair dryer 12 within the cradles 66.
3. Move the elongated semi-rigid flexible tube 46, so that the barrel 28 of the portable hair dryer 12 is aimed at the hair 18 of the person 16.

4. Depress the on/off switch 36 to turn the fan motor 26 on within the housing 22 in the portable hair dryer 12.
5. Adjust the heat switch 38 to operate the heater 30 within the barrel 28 in the portable hair dryer 12, so that the hot air 32 will blow upon the hair 18 of the person, thus leaving the hands 20 of the person 16 free to do other things.

LIST OF REFERENCE NUMBERS

10 hands free hair dryer and holder
12 portable hair dryer of 10
14 supporting structure of 10
16 person
18 hair of 16
20 hand of 16
22 housing of 12
24 air vent in 22
26 fan motor in 22
28 barrel of 12
30 heater in 12
32 hot air
34 connector handle of 12
36 on/off switch of 12
38 heat switch of 12
40 power cord of 12
42 plug of 12
44 wall socket
46 elongated semi-rigid flexible tube for 14
48 attaching facility of 10
49 wall
50 mounting plate for 48
52 adhesive layer between 50 and 49
54 screw of 48
56 door of 58
58 cabinet
60 table/counter top
62 connector of 14
64 crossbar of 14 on 62
66 cradle of 14 on 64
68 C-shaped member of 66
70 non-slip pad of 66 in 68

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hands free hair dryer and holder comprising:

a) a portable hand dryer;

b) cradle means for supporting said dryer comprising a pair of spaced, C-shaped open mouth cradles in parallel relationship joined and held together by a crossbar connecting said cradles, said crossbar being attached to said cradles adjacent one end of each of said cradles so that said cradles extend away from said crossbar, the open mouth of each of said cradles being lined with a non-slip pad; and c) an elongated semi-rigid flexible tube which can be bent in any direction and maintained in that position until changed attached at one end to said crossbar, the opposite end of said tube terminating in means for supporting said tube with said cradles in any preselected position.

* * * * *